US006325184B1

(12) United States Patent
Lujan

(10) Patent No.: US 6,325,184 B1
(45) Date of Patent: Dec. 4, 2001

(54) GRAVITY BRAKE

(75) Inventor: Richard E. Lujan, Santa Fe, NM (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/520,310

(22) Filed: Mar. 7, 2000

(51) Int. Cl.[7] ..... A62B 1/14
(52) U.S. Cl. ..... 188/185; 187/81; 187/366
(58) Field of Search ..... 188/184, 185, 188/187, 188, 189; 187/356, 361, 366

(56) References Cited

U.S. PATENT DOCUMENTS 1,046,609 * 12/1912 Kosztura ..... 187/366
4,151,981 5/1979 Gennep .
4,359,207 11/1982 Maryonovich et al. .
4,552,248 11/1985 Payne .
4,797,075 * 1/1989 Edwards et al. ..... 188/185
4,809,823 * 3/1989 Fargier ..... 188/185
4,813,493 3/1989 Shaw et al. .
5,701,972 * 12/1997 Bloder ..... 188/185

FOREIGN PATENT DOCUMENTS

240722 * 10/1925 (GB) ..... 187/81

* cited by examiner

*Primary Examiner*—Matthew C. Graham
(74) *Attorney, Agent, or Firm*—John P. O'Banion

(57) ABSTRACT

A mechanical gravity brake that prevents hoisted loads within a shaft from free-falling when a loss of hoisting force occurs. A loss of hoist lifting force may occur in a number of situations, for example if a hoist cable were to break, the brakes were to fail on a winch, or the hoist mechanism itself were to fail. Under normal hoisting conditions, the gravity brake of the invention is subject to an upward lifting force from the hoist and a downward pulling force from a suspended load. If the lifting force should suddenly cease, the loss of differential forces on the gravity brake in free-fall is translated to extend a set of brakes against the walls of the shaft to stop the free fall descent of the gravity brake and attached load.

15 Claims, 4 Drawing Sheets

GRAVITY BRAKE

STATEMENT REGARDING FEDERALLY SPONSORED RESEARCH OR DEVELOPMENT

This invention was made with Government support under Contract No. W-7405-ENG-36, awarded by the Department of Energy. The Government has certain rights in this invention.

CROSS-REFERENCE TO RELATED APPLICATIONS

Not Applicable

REFERENCE TO A MICROFICHE APPENDIX

Not Applicable

BACKGROUND OF THE INVENTION

1. Field of the Invention

This invention pertains generally to a device for stopping a load in a vertical shaft and more particularly to a gravity brake that stops a load being lowered or raised in a vertical shaft after failure of a suspending member.

2. Description of the Background Art

When loads are hoisted within a vertical shaft, the load is suspended from a support member, such as a cable, and moved in a slow ascent or descent within the shaft to a desired position by means of a manual or motor-driven hoist system. Certain catastrophic failures of the supporting members or hoist system can allow the load to free fall down the shaft. Obviously such a situation can be destructive for both the load and the shaft. Furthermore, under certain conditions the free falling load poses a danger to personnel.

Therefore a need exists for a device that can stop a load from rapidly descending down a shaft should the hoisting mechanism fail. The gravity brake in accordance with the present invention satisfies that need, as well as others, and overcomes deficiencies in previously known techniques.

BRIEF SUMMARY OF THE INVENTION

The present invention comprises a gravity brake which is positioned between a suspending member, such as a cable, and a load being hoisted up or down a shaft. Should a failure occur in the suspending member, or related hoist machinery, such that the supporting force of the suspending member is released, the gravity brake extends braking arms which contact the walls of the shaft, thereby applying a braking force which stops the load from a free-fall descent.

An object of the invention is to prevent loads from free-falling down a shaft.

Another object of the invention is to provide a system of gravity braking that is very reliable.

Another object of the invention is to provide a gravity braking device that is simple to manufacture, and does not rely on complex mechanisms or electronics for its proper operation.

Another object of the invention is to provide a gravity braking device to perform the gravity braking function while providing a secure connection between upper and lower support members, such that an inoperative gravity braking mechanism will not itself cause a hoisted load to fall.

Another object of the invention is to provide a gravity braking device which can operate within shafts of various shapes and sizes.

Another object of the invention is to provide a gravity brake with a compliant braking action whereby braking occurs even in shafts with slightly varying cross-sections and irregularities.

Another object of the invention is to provide a gravity braking device which employs the force differential between a lifting force and a loading force to extend a set of brakes.

Another object of the invention is to provide a gravity braking design that can be scaled for use in shafts of various sizes.

Another object of the invention is to provide a gravity braking device whose brake pad material and surface texture can be easily configured to suit the particular shaft material and environmental conditions.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 4. It will be appreciated that the apparatus may vary as to configuration and as to details of the parts, and that the method may vary as to the specific steps and sequence, without departing from the basic concepts as disclosed herein.

Figure 1:
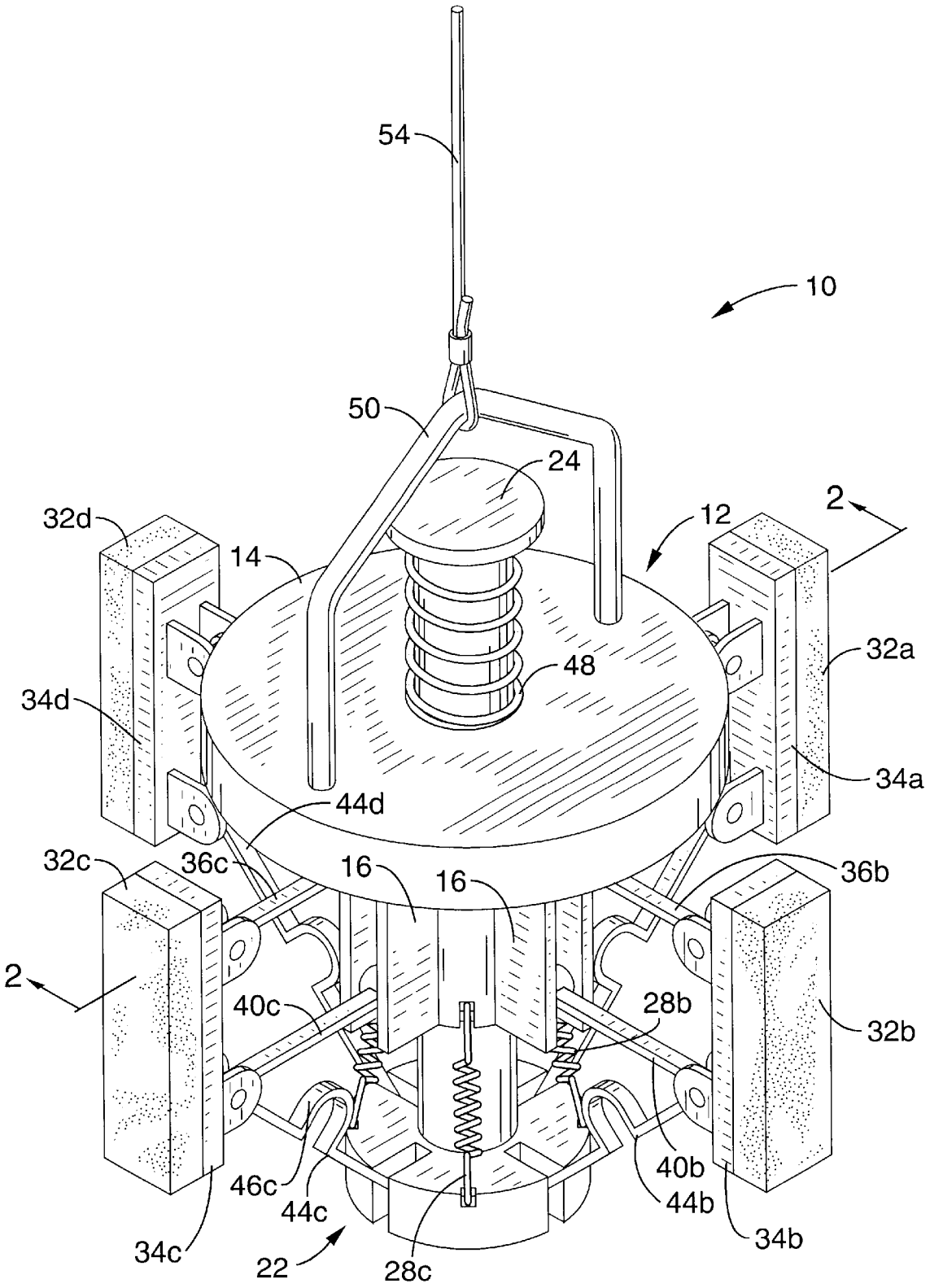
FIG. 1 is a perspective view of a gravity braking apparatus according to the invention, shown with brake pads extended.

Referring first to FIG. 1, an embodiment of a gravity brake 10 according to the invention is shown with four extended braking pads 32*a–d*, a base member 12 with a top 14, and a lower section 16. The base member 12 contains a sliding center shaft 22 biased by extension springs 28*a–d*, or alternatively compression spring 48. Expressed in terms of general function, the base member 12 can alternatively be considered a hoisting member, while the sliding center shaft 22 can be considered the loading member or load connection member. The combination of base member 12 and sliding center shaft 22 under bias force from the springs 28*a–d* comprise a body which extends or elongates when lift and load forces act in opposition thereupon. Thus, the body moves between an unextended position when no opposing forces are applied between its ends (e.g., in its rest position) to an extended position when outwardly directed opposing forces are applied (e.g., in its loaded position). It is also possible, though far less preferable, to use an extension member which contracts under opposing forces to urge brake deployment.

FIG. 1 depicts the gravity brake with its brakes extended. When a load is added below the gravity brake 10 the sliding shaft 22 moves downward in relation to the base member against the bias force of the springs 28*a–d*, an elongation or extension of the combined elements occurs which causes the mechanically coupled braking arms to retract downward to their normal operating position (non-braking position) while a load is being hoisted.

Figure 2:
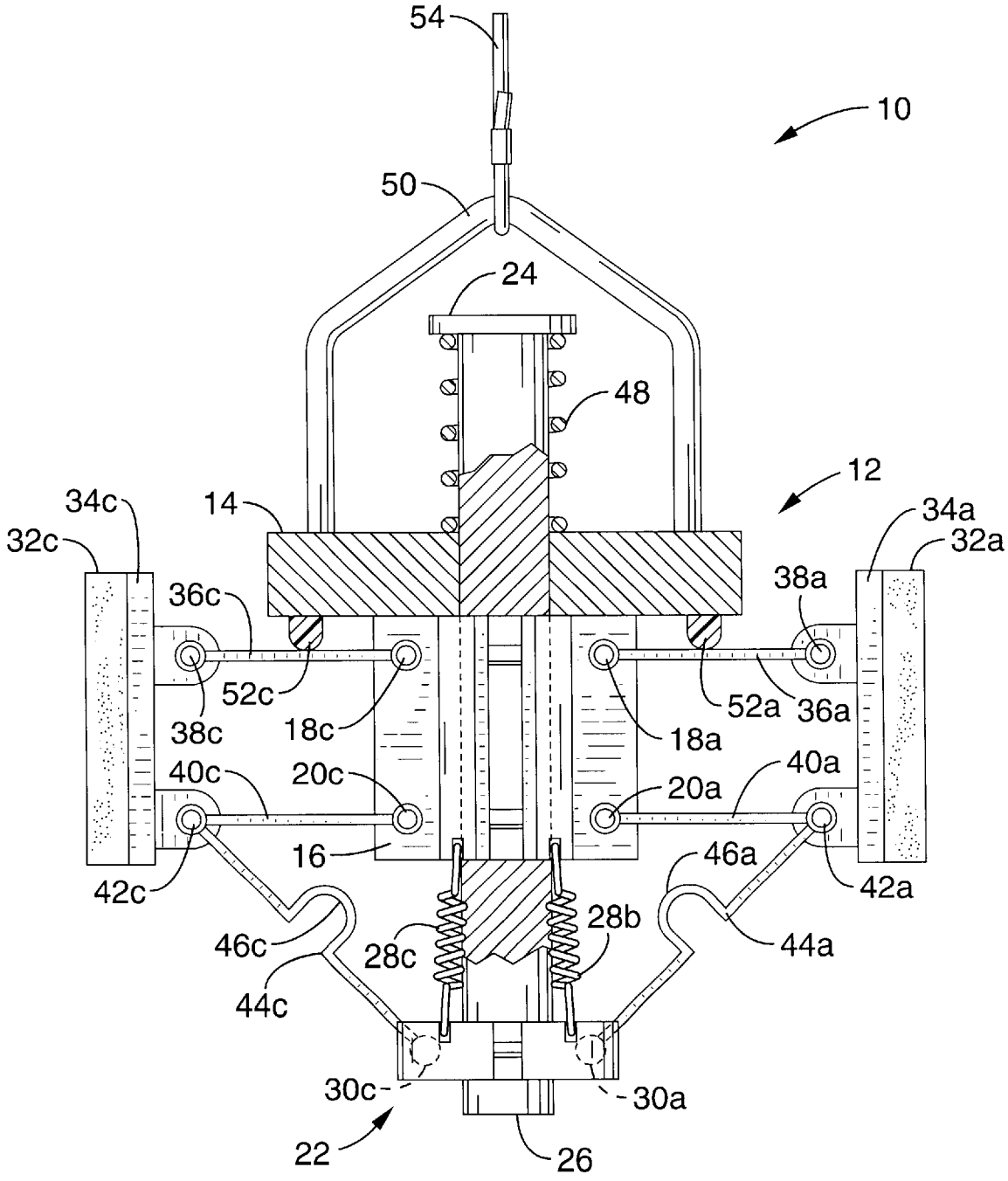
FIG. 2 is a cross-sectional view of the gravity braking apparatus shown in FIG. 1, shown with brake pads extended taken through section 2—2.

FIG. 2 shows the gravity brake 10 in partial cross-section with the brakes extended for braking. A base member assembly 12 is shown with a top section 14 and a lower portion 16 configured for connection of upper link pivots 18*a–d*, and lower link pivots 20*a–d*. The top section is shown as round but may be alternatively configured in any one of a number of shapes compatible with the shaft in which it is to be used (e.g. a polygon). Slidably connected through the base member assembly 12 is a center shaft assembly 22 having a top 24 configured as a stop to prevent overextension of the center shaft, and a bottom section 26 configured for attachment of a cable or equivalent support member for supporting a load. The center shaft assembly 22 is biased toward the base member 12 by springs 28*a–d* connected therebetween. Alternatively, compression spring 48 is shown to produce the upward bias of shaft 22 within the base member 12. The biasing springs urge the base member 12 and the bottom of center shaft assembly 22 toward one another into a contracted state as shown.

Brake pads 32*a–d* provide a surface which is applied against the inner walls of the shaft to stop the descent of the gravity brake 10 and load (not shown). The brake pads 32*a–d* are attached to brake pad supports 34*a–d*, preferably covering a substantial portion of the brake pad support. The brake pad supports 34*a–d* are connected with upper swing links 36*a–d* that connect the upper pad support pivots 38*a–d* with pivots 18*a–d* on the base member 12. Similarly, lower swing links 40*a–d* connect the lower pad support pivots 42*a–d* with pivots 20*a–d* on the base member 12. The use of more than one swinging arm per brake pad is preferred as this arrangement retains the brake pad in a fixed angular alignment relative to the center shaft of the gravity brake during brake deployment. The swing links and brake pad supports can be configured to support a variety of load factors, with lighter weight materials and/or construction used for supporting lighter hoisted loads. Activating links 44*a–d* connect each brake pad support 34*a–d* at the lower pivot 42*a–d* to the sliding center shaft assembly at the link pivot points 30*a–d*. Each activating link is constructed with a compliant section, shown here as a spring loop 46.

Gravity brake 10 is shown connected by means of a hoist attach bracket 50 to a supporting cable 54. No load is shown connected underneath the sliding shaft assembly 22. Aside from the weight of the sliding shaft itself there are no forces acting to extend the center shaft 22 downward, and therefore the bias springs 28*a–d* pull the center shaft assembly 22 up towards the base member 12 which moves the activating links 44*a–d* to thereby raise the brake pads 32*a–d* until they are fully extended against the stops 52*a–d*. The biasing springs 28*a–d* can alternatively be replaced by a single compression spring 48 encircling the sliding shaft assembly 22 and compressibly retained between the top 24 of the sliding shaft 22 and the top of the base member 12. The stops prevent the swing links from swinging past center, which would result in a loss of braking force. Preferably the stops incorporate a shock absorbing material which absorbs the impact of the upper swing links 36*a–d* as they strike the stops, thus preventing swing link damage. The gravity brake is preferably sized, in relation to the diameter of the shaft, so that the brakes contact the walls of the shaft just prior to reaching full extension.

Figure 3:
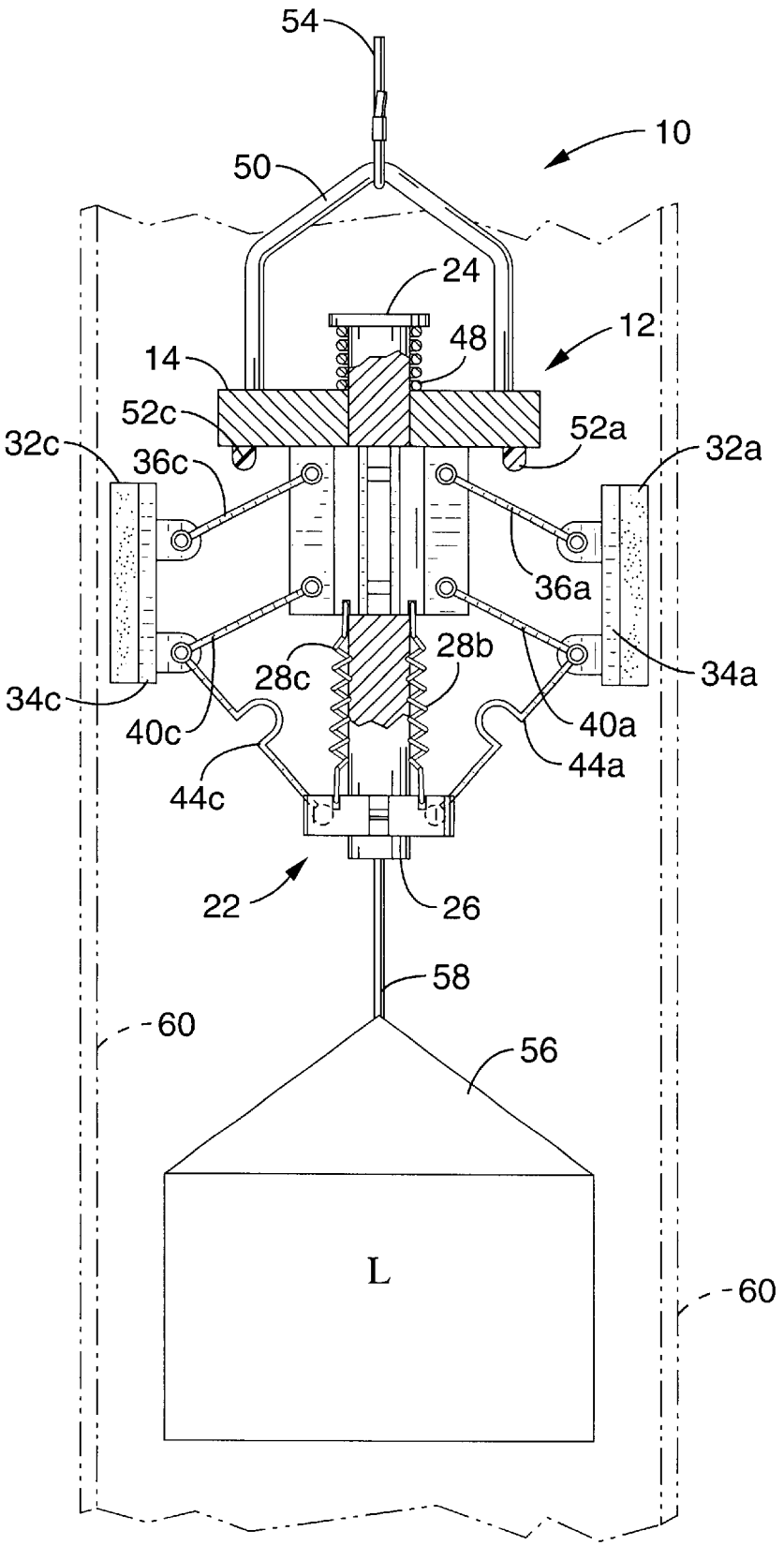
FIG. 3 shows the gravity braking apparatus of FIG. 2 hoisting a load L within a shaft.

FIG. 3 depicts this embodiment of the gravity brake 10 while in use within a shaft hoisting a load L. The upper hoist attachment bracket 50 attaches the base member assembly 12 to an upper support member 54, which is typically a cable, chain, or rope.

The lower end 26 of the center shaft assembly 22 is connected to a load L 56 through a support member 58, again this member is typically a cable, chain, or rope. The load 56 is shown being hoisted within the walls 60 of a shaft. The number and shape of the brake pads and links within the gravity brake can be configured for use in shafts having various cross sections, such as round, square, hexagonal, or rectangular. The hoist through cable member 54 and the load through cable member 58, provide opposing forces on the gravity brake 10. The opposing forces act to move the center shaft assembly 22 downward which thereby moves the activation links 44*a–d* to cause the attached brake pads 32*a–d* to remain swung down away from the walls 60 of the shaft. If the load 56 exceeds the combined force of the springs 28*a–d*, or one or more springs were to break, then the top section 24 of the center shaft 22 provides a stop which prevents dropping of the load 56 being hoisted.

Figure 4:
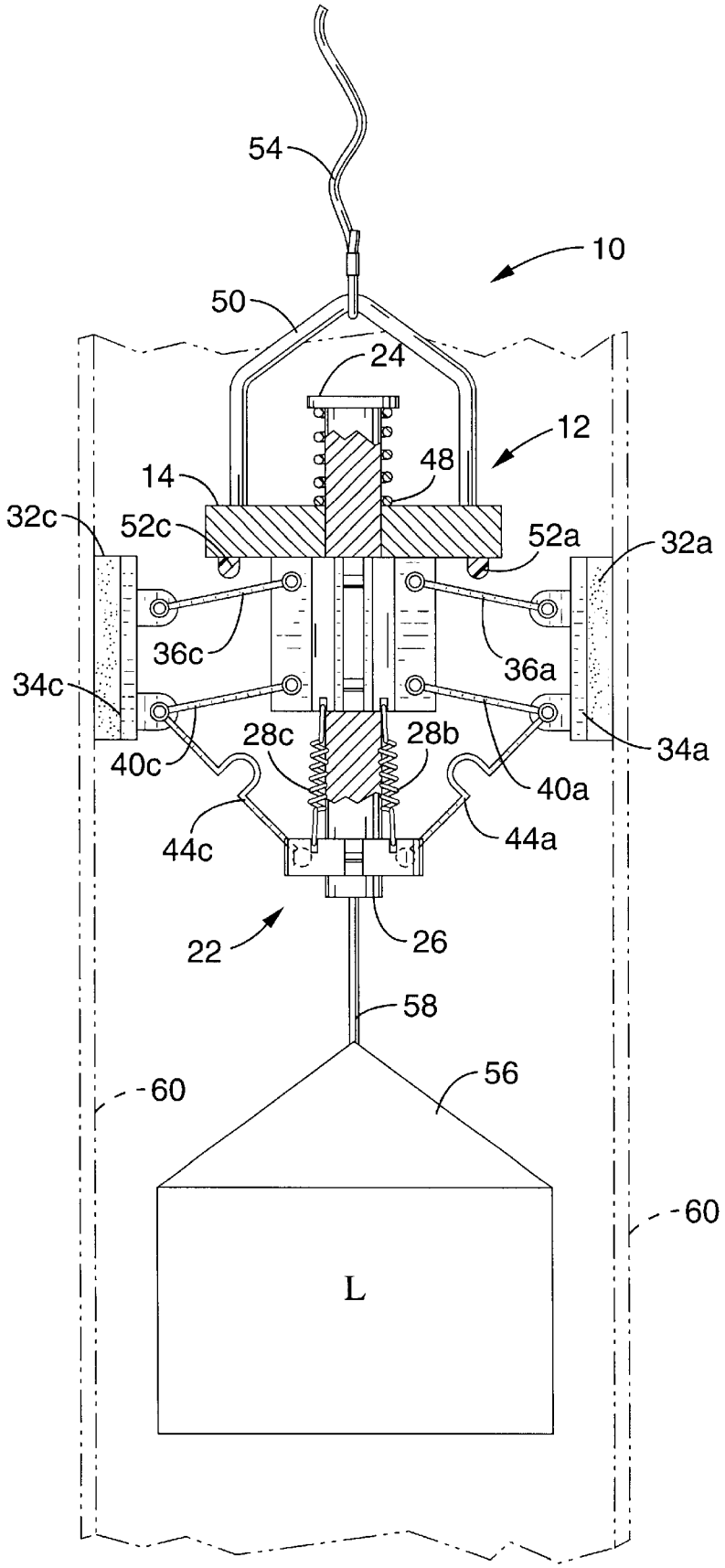
FIG. 4 shows the gravity braking apparatus and load L of FIG. 3 shortly after breakage of the hoist support cable.

If the hoist fails with a sudden cessation of support to the weight of the gravity brake 10 plus load 56, then both the gravity brake 10 and the load 56 begin free-falling. With opposing forces eliminated the gravity brake 10, under the bias springs 28*a–d*, thereby contracts which activates links 44*a–d* causing the brake pads 32*a–d* to swing outwardly until contact is made with the walls 60 of the shaft. The brake pads 32*a–d* under the bias force create friction which pulls the pads farther back while driving them slightly farther outward under the force of the load 56. It should be noted that the swing links 36*a–d*, 40*a–d*, should not be allowed to swing upward past the horizontal within this embodiment as this would reduce braking forces. The braking provided by the gravity brake causes the combined assembly to stop quickly within the shaft as shown in FIG. 4. On shafts under 12 inch diameter it is anticipated that the gravity brake will stop the load within one second after a sudden failure of the hoist mechanism.

The load, or loads, supported under the gravity brake provide a force which opposes the hoisting force when the gravity brake is in a non-free-fall state. It should be recognized, however, that the gravity brake is capable of stopping the free fall of one or more loads which are suspended above the gravity brake. Furthermore, if the intended load is supported above the gravity brake, then the force which opposes the hoisting force may be alternatively supplied by attaching sufficient weight to the center shaft assembly, or by configuring the gravity brake such that the weight of the center shaft assembly itself, when in a non-free-fall state, can overcome the bias toward the base member. In this way the gravity brake may be operated to stop the free fall of multiple loads which are suspended below and/or above the gravity brake.

It must be recognized that the use of four brake members as described is by way of example and not of limitation. The invention may be practiced using two or more brake arms. The preferred number of arms used is dependent upon on the shape and size of the shaft. It is anticipated that typically the invention will be practiced with from two to six brake arms in small shafts of up to sixteen inches in diameter, and with additional braking arms being added to the design for use in larger shafts. Any desired number of arms would be suitable within small round shafts, although the use of three may be preferable for quick centering of the gravity brake in the shaft, while two or four arms are preferred for use in a small rectangular or square shaft. It will be appreciated that the invention can be implemented in a variety of ways. As mentioned previously the embodiment described employs four swinging brake arms yet a gravity brake can be made according to the invention comprising two or more arms with brake pads. The sliding center shaft assembly 22 and base assembly 12 are biased toward one another via springs 28*a–d* and alternatively by means of compression spring 48 within the described embodiment. The invention, however, can be implemented to form an elongation member in other ways as well, such as using a compliant elongation member, or a pair of hinged members biased toward one another. The brakes of the embodiment are activated by swinging into position under the bias force and then the weight of the load, however the brakes could be deployed as linearly extending radial arms that do not swing into position. The loss of the paired opposing forces across the gravity brake can trigger spring engaged arms to directly extend to brake against the walls of the shaft. Although the concept of an elongation member contracting upon a loss of opposing forces is greatly preferred, in a larger context a compression member may be employed instead whereas the brake extension mechanism is responsive to a loss of compression (extension). The preceding are but a few examples of the alternative implementations for the present invention.

Accordingly, it will be seen that this invention, a gravity brake to stop hoisted loads from free-falling in a shaft, can be implemented in a variety of ways. Although the description above contains many specifics, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus to stop loads from free-falling, comprising:

(a) a base member configured for attachment to a hoist mechanism which provides vertical support;

(b) a load connection member configured for attachment to a load, said load connection member comprising a shaft slidably coupled to, and capable of being biased toward, the base member; and (c) a plurality of brake members operatively coupled to said base member and said load connection member such that under a loss of opposing forces applied to said base member and said load connection member, the load connection member under a bias force moves toward the base member and a mechanical linkage moves to extend the brake members.

2. An apparatus as recited in claim 1, wherein the load connection member is prevented from overextension relative to the base member by a stop member.

3. An apparatus as recited in claim 1, wherein one or more springs supply biasing force between said base member and said load connection member.

4. An apparatus as recited in claim 1, wherein the brake members comprise brake pads attached to brake pad supports.

5. An apparatus as recited in claim 1, wherein said brake members have an exterior contour configured to generally match the shape of the interior walls of a shaft when extended.

6. An apparatus as recited in claim 1, wherein the brake members are rotatably extendible in response to force supplied by biasing between the load connection member and the base member.

7. An apparatus as recited in claim 1, wherein rotatable extension of said brake members is controlled by the movement of at least one brake extension link connected to the load connection member, and wherein said brake members moving in response to changes in the relative position of the load connection member to the base member.

8. An apparatus to stop loads from free-falling, comprising:

(a) a base member configured for attachment to a hoist mechanism which provides vertical support;

(b) a load connection member configured for attachment to a load, said load connection member moveably coupled to, and capable of being biased toward, the base member; and (c) a plurality of brake members operatively coupled to said base member and said load connection member such that under a loss of opposing forces applied to said base member and said load connection member, the load connection member under the bias force moves toward the base member and a mechanical linkage moves to extend the braking members;

(d) wherein the brake members are rotatably coupled to at least two linking members.

9. An apparatus as recited in claim 8, wherein the load connection member comprises a shaft slidably coupled to said base member.

10. An apparatus as recited in claim 8, wherein the load connection member is prevented from overextension relative to the base member by a stop member.

11. An apparatus as recited in claim 8, wherein one or more springs supply biasing force between said base member and said load connection member.

12. An apparatus as recited in claim 8, wherein the brake members comprise brake pads attached to brake pad supports.

13. An apparatus as recited in claim 8, wherein said brake members have an exterior contour configured to generally match the shape of the interior walls of a shaft when extended.

14. An apparatus as recited in claim 8, wherein the brake members are rotatably extendible in response to force supplied by biasing between the load connection member and the base member.

15. An apparatus as recited in claim 14, wherein rotatable extension of said brake members is controlled by the movement of at least one brake extension link connected to the load connection member, and wherein said brake members moving in response to changes in the relative position of the load connection member to the base member.

* * * * *